US007145107B2

(12) United States Patent
Nguyen et al.

(10) Patent No.: US 7,145,107 B2
(45) Date of Patent: Dec. 5, 2006

(54) TAMPER RESISTANT TEMPERATURE DIAL UTILIZING DEFLECTION PINS

(75) Inventors: Can Trong Nguyen, Anaheim, CA (US); Raymond-Paul Joubran, Pasadena, CA (US)

(73) Assignee: Robertshaw Controls Company, Richmond, VA (US)

( * ) Notice: Subject to any disclaimer, the term of this patent is extended or adjusted under 35 U.S.C. 154(b) by 104 days.

(21) Appl. No.: 10/907,356

(22) Filed: Mar. 30, 2005

(65) Prior Publication Data

US 2006/0237435 A1 Oct. 26, 2006

(51) Int. Cl.
*H05B 1/02* (2006.01)

(52) U.S. Cl. ..... 219/491; 219/494; 74/553; 292/347

(58) Field of Classification Search ..... 219/490–494, 219/506; 292/347–350; 74/553, 527
See application file for complete search history.

(56) References Cited

U.S. PATENT DOCUMENTS

| | | | | |
|---|---|---|---|---|
| 1,068,961 | A | 7/1913 | Baker | |
| 1,104,918 | A | 7/1914 | Mouat | |
| 1,473,774 | A | 11/1923 | Leech, Jr. | |
| 1,651,038 | A | 11/1927 | Muller | |
| 1,673,454 | A | 6/1928 | Hochstein | |
| 1,689,236 | A | 10/1928 | Fraser, Jr. | |
| 2,253,162 | A | 8/1941 | Ayers | |
| 2,953,937 | A | 9/1960 | Jackson et al. | |
| 3,203,265 | A | 8/1965 | Flegel | |
| 3,537,473 | A | 11/1970 | DeZurik, Jr. | |
| 3,597,138 | A | 8/1971 | Ray | |
| 3,810,064 | A | 5/1974 | Flegel | |
| 4,235,323 | A | 11/1980 | Dykzeul | |
| 4,588,851 | A | 5/1986 | Turner | |
| 4,635,680 | A | 1/1987 | Fang | |
| 4,895,043 | A | 1/1990 | Lee | |
| 4,991,461 | A * | 2/1991 | Sennett et al. | 74/553 |
| 5,003,803 | A | 4/1991 | Richards | |
| 5,230,465 | A | 7/1993 | Kostorz et al. | |
| 5,363,720 | A | 11/1994 | Sanchez | |
| 5,427,135 | A | 6/1995 | Kieper | |
| 5,427,140 | A | 6/1995 | Bosanquet | |
| 5,513,831 | A | 5/1996 | Seward | |
| 5,537,893 | A | 7/1996 | Snider | |
| 5,590,682 | A | 1/1997 | Fischer | |

(Continued)

FOREIGN PATENT DOCUMENTS

| | | |
|---|---|---|
| DE | 805 242 C | 5/1951 |

(Continued)

*Primary Examiner*—Mark Paschall
(74) *Attorney, Agent, or Firm*—Leydig, Voit & Mayer, Ltd

(57) ABSTRACT

An adjustment interface for adjusting a controller teaches a novel apparatus and method for controlling the temperature of a heating device comprising a controller cover panel having a rotatable controller dial; a ring member mounted to axially extend beyond and away from the exterior surface, wherein the ring member has projections radially extending from an exterior perimeter of the ring member; and said rotatable controller is operatively connectable to a rotatable controller adjustment and said control dial operable to effect rotation of the rotatable adjustment member when said control dial is grasped and turned and said control dial having a deflection pin extending therefrom having sufficient length and orientation to crossingly engage the projections extending from the exterior perimeter of the ring member such that the deflection pin resistively engages the projections and flexes to travel radially over and disengaging the projections when the control member is turned.

14 Claims, 2 Drawing Sheets

U.S. PATENT DOCUMENTS

| | | | |
|---|---|---|---|
| 5,647,389 | A | 7/1997 | Holloway |
| 5,950,982 | A | 9/1999 | Williams |
| 6,012,445 | A | 1/2000 | Santelli, Jr. |
| 6,340,148 | B1 | 1/2002 | Sung |
| 6,347,784 | B1 | 2/2002 | Philipps-Liebich et al. |
| 6,375,150 | B1 | 4/2002 | Aguirre-Esponda et al. |
| 6,471,135 | B1 | 10/2002 | Paolucci |
| 6,571,829 | B1 | 6/2003 | Kuriyama et al. |
| 6,617,954 | B1 | 9/2003 | Firestine |
| 6,745,725 | B1 | 6/2004 | Toniolo et al. |
| 2002/0121305 | A1 | 9/2002 | Firestine |

FOREIGN PATENT DOCUMENTS

| | | |
|---|---|---|
| WO | WO 02/06712 | 1/2002 |

* cited by examiner

TAMPER RESISTANT TEMPERATURE DIAL UTILIZING DEFLECTION PINS

BACKGROUND OF THE INVENTION

The temperature of the water within a water heater is usually maintained and adjusted by a rotatable temperature dial. In the case of a gas-fired water heater, there is a temperature dial that is operatively connected to a gas controller valve that directs the flow of gas to a burner whenever the temperature of the water falls below the set temperature. For an electric water heater, there is a temperature dial that is operatively connected to a thermostat that directs electricity to a heating element whenever the temperature of the water falls below the set temperature.

Excessive water temperature is a hazard in that it may cause scalding at any of the various faucets or appliances serviced by the water heater. Accidental or inadvertent adjustment of the temperature dial can cause water to issue at unexpectedly high temperatures.

The temperature dial is located in a position that is typically, easily reached and rotated. If the water heater is located in a readily accessible location, the temperature dial can easily be tampered with, or moved, by people or things coming into contact with the temperature dial.

Properly securing a water heater from this type of tampering typically results in additional cost and/or inconvenience as to its use. Locking the water heater into an enclosure requires either keys to be kept or a combination to be remembered. An enclosure may also hamper the installation, replacement, or servicing of the water heater. Other solutions require a screwdriver or other tool to change the temperature of the temperature dial. An example of this type of device is described in U.S. Pat. No. 6,617,954, that issued on Sep. 9, 2003, which is incorporated herein by reference.

Some of the devices that have previously been developed that are associated directly with a control knob or valve to prevent tampering either involve a substantial additional cost of manufacturing or are very inconvenient to use. These devices can either lock the temperature dial or the gas controller valve/thermostat into place to physically prevent it from being rotated. Other devices serve to decouple the temperature dial and the gas controller valve or the temperature dial and the thermostat from an internal actuation mechanism. In addition to the increased costs in manufacturing, such devices are often difficult to retrofit to existing installations.

As such, a significant problem is the inadvertent adjustment of a temperature dial and the lack of a solution that does not involve a major inconvenience or increased manufacturing costs.

The present invention is directed to overcoming one or more of the problems as set forth above.

SUMMARY OF INVENTION

This invention relates generally to temperature control dials and, more particularly, to tamper resistant temperature control dials for a heating device, such as for example a hot water heater.

In one aspect of this invention, a temperature adjustment device associated with a controller for a heating device is disclosed. This includes a rotatable dial for setting temperature in the heating device, a ring that is operatively attached to the controller cover panel over which the rotatable dial rotatably mounts, wherein the ring includes a plurality of serrations, and wherein the rotatable dial has a resilient deflecting pin extending from an inner face of the rotatable dial such that an end of the deflecting pin is positioned to be engageable with at least one of the plurality of serrations on the ring such that the pin releasably applies resistance against the serrated portions when turning the rotatable dial, and a second portion of the dial that is operatively attached to the controller.

In another aspect of this invention, a temperature adjustment device associated with a controller for a heating device is disclosed. This includes a rotatable dial for setting temperature in the heating device, a ring that is operatively attached to the controller cover panel, wherein the ring includes a plurality of notched portions, and the rotatable dial includes three resilient deflection pins, each having a first end portion engageable with at least one of the plurality of notched portions on the ring, and each having a second end portion for connecting to the rotatable dial, wherein the deflection pins releasably apply resistance against the notches or serrations disengaging the first end portion from the at least one of the plurality of notched portions on the ring.

In yet another aspect of the present invention, a method for adjusting temperature of a controller for a heating device with an adjustment device is disclosed. This method includes providing three resilient deflection pins that are angularly positioned about a perimeter portion of a dial about approximately 120 degrees apart and a plurality of notched portions on a ring that are directional serrations that provide greater resistance to the deflection pins in a first direction of rotation and lesser resistance in the opposing direction of rotation.

Still yet another aspect of the present invention, a method for adjusting temperature of a controller for a heating device with an adjustment device is disclosed. This method includes rotating a rotatable dial in a first predetermined direction to lower a temperature in the heating device to a selected lower temperature, applying sufficient torque to the dial to disengage a first end portion of the resilient deflection pin from at least one of a plurality of notched portions on a ring and rotating with sufficient torque the rotatable dial in a second predetermined direction to raise the temperature in the heating device to a selected higher temperature, wherein the resilient deflection pin encounters greater resistance in one direction of rotation against a first end portion of the resilient deflection pin with the at the least one of a plurality of notched portions on the ring that is operatively attached to the rotatable dial to position the rotatable dial for the selected temperature.

These are merely some of the innumerable aspects of the present invention and should not be deemed an all-inclusive listing of the innumerable aspects associated with the present invention. These and other aspects will become apparent to those skilled in the art in light of the following disclosures and accompanying drawings.

These and other advantageous features of the present invention will be in part apparent and in part pointed out herein below.

BRIEF DESCRIPTION OF DRAWINGS

For a better understanding of the present invention, reference may be made to the accompanying drawings in which.

DETAILED DESCRIPTION OF THE INVENTION

Figure 1:
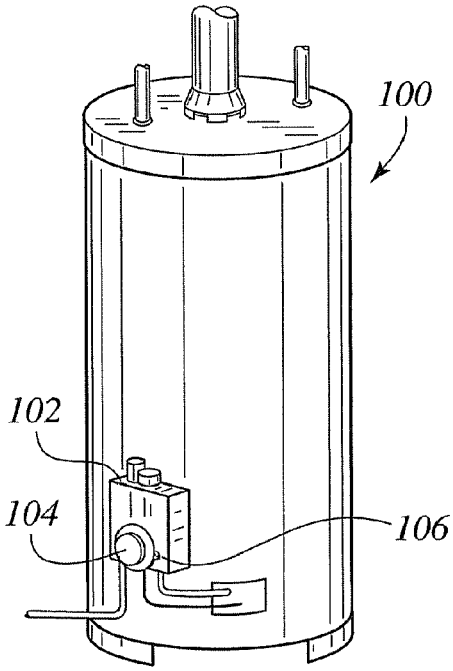
FIG. 1 is a temperature heating device having an adjustment interface.

According to the embodiment(s) of the present invention, various views are illustrated in FIGS. 1–4 and identical reference numerals are being used consistently throughout to refer to the same parts of the invention for all of the various views and figures of the drawing. Please note that the first digit(s) of the reference number for a given item or part of the invention should correspond to the FIG. number in which the item or part is first identified.

One embodiment of the present invention comprising an adjustment interface for adjusting a controller teaches a novel apparatus and method for controlling the temperature of a heating device comprising a controller cover panel having a rotatable controller adjustment member having an end portion extending through an opening of the controller cover panel beyond an exterior surface of said controller cover panel, wherein said rotatable controller adjustment member is operable to adjust a controller when said rotatable member is rotated; a ring member mounted to axially extend beyond and away from the exterior surface of said controller cover panel in substantially the same direction as the extension of the rotatable adjustment member, wherein the ring member has projections radially extending from an exterior perimeter of the ring member; and a control member operatively connected to said rotatable controller adjustment member beyond the axial extension of the ring member and said control member operable to effect rotation of the rotatable adjustment member when said control member is grasped and turned and said control member having a deflection pin extending therefrom having sufficient length and orientation to crossingly engage the projections extending from the exterior perimeter of the ring member such that the deflection pin resistively engages the projections and flexes to travel radially over and disengaging the projections when the control member is turned with sufficient torque.

One embodiment of the control member can be a dial that is attachable to the end of a rotatable controller adjustment member, which can be a rotatable shaft. One embodiment of the ring member is mounted to the exterior surface of the controller cover panel and the dial has a plurality of pins having sufficient length and orientation to crossingly engage projections extending from the exterior perimeter of the ring member such that the plurality of pins resistively engage the projections and flex to travel radially over and disengaging the projections when the control member is turned with sufficient torque.

One embodiment of the dial can be circular in shape and have an inner dial surface and wherein the plurality of pins extend from the inner dial surface to engage the projections and the plurality of pins can comprise three pins angularly spaced about a perimeter of the dial about approximately 120 degrees apart pin to pin. One embodiment of the projections are a series of directional serrations whose points directionally project to provide greater resistance to rotation of the dial in a first direction of rotation and lesser resistance to rotation of the dial in an opposing second direction of rotation.

One embodiment of the rotatable controller adjustment member can be operatively connected to a gas valve controller for controlling gas valve operation for a gas-fired heating device. Whereas, one embodiment of the rotatable adjustment member can be operatively connected to an electrical heating element controller for controlling electrical heating element operation for an electrically-fired heating device.

The method for adjusting a controller that controls the temperature of a heating device comprises the steps of providing a controller cover panel interface having a rotatable controller adjustment member having an end portion extending through an opening of the controller cover panel beyond an exterior surface of said controller cover panel, wherein said rotatable adjustment member is operable to adjust a controller when said rotatable member is rotated; providing a ring member mounted to axially extend beyond and away from the exterior surface of said controller cover panel in substantially the same direction as the extension of the rotatable adjustment member, wherein the ring member has projections radially extending from an exterior perimeter of the ring member; providing a control member operatively connected to said rotatable adjustment member beyond the axial extension of the ring member and said control member operable to effect rotation of the rotatable adjustment member when said control member is grasped and turned and said control member having a pin extending therefrom having sufficient length and orientation to crossingly engage the projections extending from the exteriror perimeter of the ring member such that the pin resistively engages the projections and flexes to travel radially over and disengaging the projections when the control member is turned with sufficient torque; and rotating the control member with sufficient torque to effect rotation.

The details of the invention and various embodiments can be better understood by referring to the Figures. FIG. 1 is an illustrative perspective view of a heating device 100. The heating device 100 as shown in FIG. 1 is illustrative of a hot water heater, however, this application and the claims herein are in no way limited to a hot water heating device. There is a controller unit 102 attached to the heating device 100. The controller unit 102 can include but is not limited to a gas control valve for controlling gas flow as well as a thermostat for sensing temperature. Alternatively, the controller unit 102 could include an electrical current regulator and thermostat for controlling an electrical heating element of the heating device. The controller unit 102 is operable to control the heat source to maintain a desired temperature. The controller unit 102 can include a controller cover panel 106 which further comprises an interfacing control member 104 which is illustrated as a rotatable control dial. The control dial 104 can be utilized to adjust the controller unit 102 thereby controlling the temperature. The control dial 104 can be grasped and turned with sufficient torque in a counter-clockwise and clockwise direction in order to vary the temperature setting.

Figure 2:
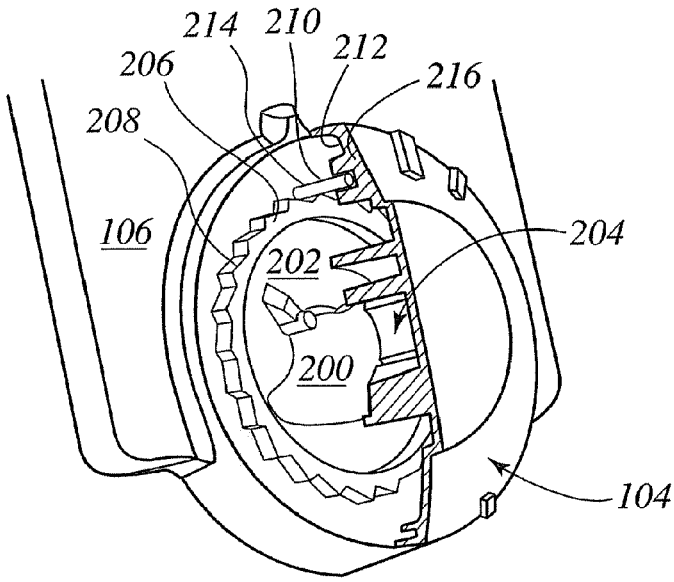
FIG. 2 is a cut-away sectional perspective view of the control dial and controller panel interface.

Referring to FIG. 2, a cut-away sectional view of the interfacing control member 104 and controller unit 102 is shown, which reveals the interfacing control member 104 and controller unit 102. The controller unit 102 has a controller cover panel 106. The controller unit 102 can include a rotatable controller adjustment member (not shown) which extends through an opening 200 of the controller cover panel 106. The rotatable controller adjustment member can be for example a shaft extending through the opening 200 of the controller cover panel 106 beyond an exterior surface 202 of the controller cover panel 106 where the rotatable controller adjustment member or rotatable shaft is operable to rotate and adjust the controller when said rotatable shaft is rotated in a clockwise and counter-wise manner. A first end of the rotatable shaft can operably connect in an opening 204 of the interfacing control member 104. The interfacing control member 104 is shown in FIG. 2 as a circular dial that can be turned with sufficient torque such that the rotatable controller adjustment shaft attached thereto is rotated thereby controlling the control unit.

A ring member 206 is mounted to actually extend beyond and away from the exterior surface 202 of the controller cover panel 106 in substantially the same direction as the extension of a rotatable controller adjustment shaft. The ring member 206 can have radial projections 208 readily extending from an exterior perimeter of the ring member 206. The radial projections 208, e.g., serrations, form a series of notches or serrations as shown in FIG. 2. The radial projections 208, e.g., serrations, shown in FIG. 2 are shown as directional serrations whose points directionally project to provide greater resistance to rotation of the dial in a first direction of rotation and a lesser resistance to the rotation of the dial in an opposing direction of rotation. The radial projections 208, e.g., serrations, as shown will provide a greater resistance to rotation of the dial in a clockwise direction and a lesser resistance to rotation of the dial in a counter-clockwise rotation. The resistance to rotation is effected by the engagement of deflection pins 210 and the series of radial projections 208. The deflection pins 210 are shown extending from an inner dial surface 212, and which can have a first end 214 of the deflection pin 212 or inner dial surface 212 crossingly engaging of the projections or radial projections 208, e.g., serrations. The deflection pins 210 are shown for example connected to the inner dial surface 212 by being press fit into a boss 216. The deflection pins 210 have sufficient length such that a first end 214 of the deflection pin extends to crossingly engage the radial projections 208, e.g., serrations, thereby providing a greater resistance to a first direction of rotation of the dial and a lesser resistance to an opposing rotation of the dial. The example shown in FIG. 2 has directional radial projections 208, e.g., serrations, such that the dial rotation encounters a greater resistance in the clockwise direction of rotation and a lesser resistance in the counter-clockwise direction of rotation.

Figure 3:
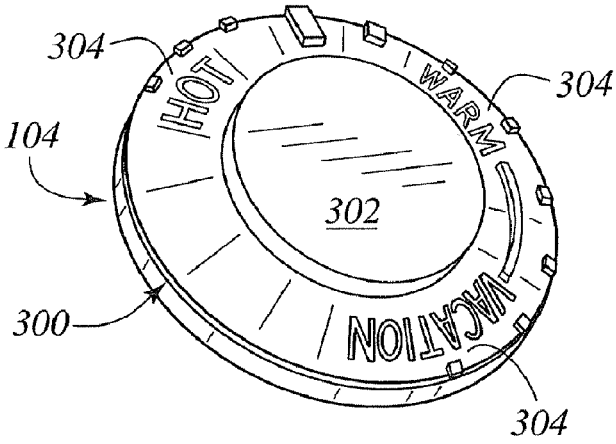
FIG. 3 is a front perspective view of the control dial.

Referring to FIG. 3, a front perspective view of the interfacing control member 104 or control dial is shown. The interfacing control member 104 includes a side rim 300 for ease of grasping and turning. The interfacing control member 104 can also include multiple graduated markings 304 as for example shown as hot, warm and vacation. The multiple graduated markings 304 can obviously vary without departing from the scope of the claimed invention. The interfacing control member 104 also has a facing surface 302.

Figure 4:
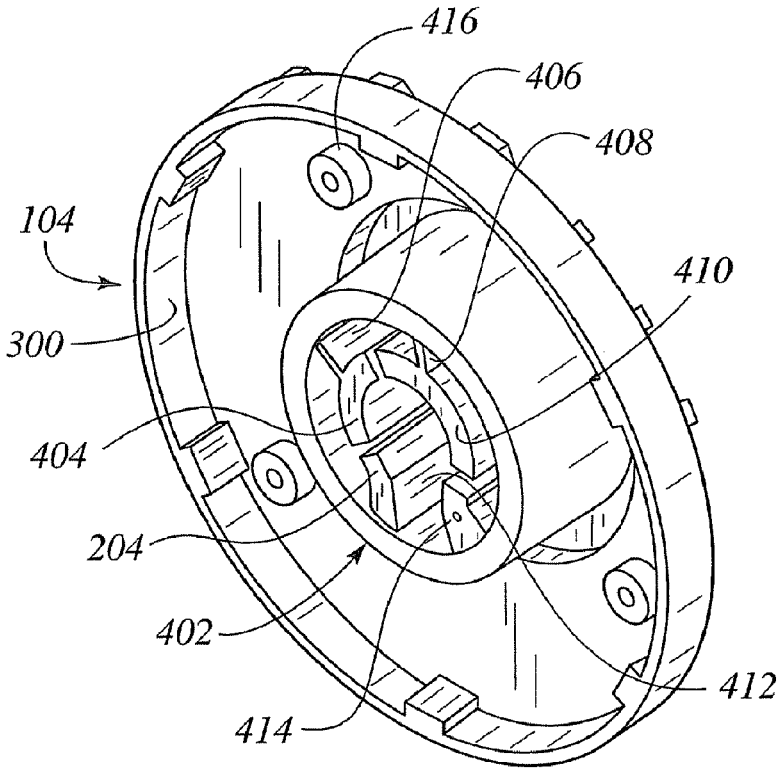
FIG. 4 is a rear perspective view of the control dial.

Referring to FIG. 4, an inside perspective of the interfacing control member 104 is shown. The inner view of the dial reveals a dial main boss member 402 for receiving a rotatable controller adjustment member or a rotatable controller shaft therein. The dial main boss member 402 can for example include various inner projections or segments 404, 406, 408, 410, 412 and 414 for adapting the dial main boss member 402 to the appropriate size for receiving the rotatable controller adjustment member. The inner projections of the dial main boss member 402 are shown for example to form an inner arcuate receptacle or opening 204 for receiving for example a cylindrical shaft or rotatable controller adjustment shaft member. The inside view of the dial also reveals the deflection pin boss member 416 for receiving the deflection pins. The inside view shown in FIG. 4 shows for example a dial that can be configured with three deflection pin bosses that are spaced about a perimeter of the inner portion of the dial and FIG. 4 illustrates for example deflection pin bosses that are angularly spaced about the perimeter of the interfacing control member 104 which have about approximately 120 degrees of separation between each of the deflection pins bosses.

Referring back to FIG. 2, when the interfacing control member 104 is grasped and turned with sufficient work, the first end 214 of the deflection pins 210 deflects readily outward to travel over the point of the radial projections 208, e.g., serrations, for which it is currently engaging. The directional serrations are designed to resist rotation thereby effectively creating a tamper resistance control dial.

The various tamper resistant temper control dial examples shown above illustrate a novel tamper resistant adjustment interface. A user of the present invention may choose any of the above interfacing control member 104 embodiments, or an equivalent thereof, depending upon the desired application. In this regard, it is recognized that various forms of the subject tamper resistant control dial interface could be utilized without departing from the spirit and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A adjustment interface for adjusting a controller that controls the temperature of a heating device comprising:

a controller cover panel having a rotatable controller adjustment member having an end portion extending through an opening of the controller cover panel beyond an exterior surface of said controller cover panel, wherein said rotatable controller adjustment member is operable to adjust a controller when said rotatable controller adjustment member is rotated;

a ring member mounted to axially extend beyond and away from the exterior surface of said controller cover panel in substantially the same direction as the extension of the rotatable controller adjustment member, wherein the ring member has projections radially extending from an exterior perimeter of the ring member; and a control member operatively connected to said rotatable controller adjustment member beyond the axial extension of the ring member and said control member operable to effect rotation of the rotatable controller adjustment member when said control member is grasped and turned and said control member having a deflection pin extending therefrom having sufficient length and orientation to crossingly engage the projections extending from the exterior perimeter of the ring member such that the deflection pin resistively engages the projections and flexes to travel radially over and disengaging the projections when the control member is turned with sufficient torque.

2. The adjustment interface as recited in claim 1, wherein the rotatable controller adjustment member is a rotatable shaft and the control member is a dial attached to the end of the rotatable shaft.

3. The adjustment interface as recited in claim 2, wherein the ring member is mounted to the exterior surface of the controller cover panel and wherein the dial has a plurality of deflection pins having sufficient length and orientation to crossingly engage the projections extending from the exterior perimeter of the ring member such that the plurality of deflection pins resistively engage the projections and flex to travel radially over and disengaging the projections when the control member is turned with sufficient torque.

4. The adjustment interface as recited in claim 3, wherein the dial is circular in shape and having an inner dial surface and wherein the plurality of deflection pins extend from the inner dial surface to engage the projections and wherein the plurality of deflection pins comprise three pins angularly spaced about a perimeter of the dial about approximately 120 degrees apart deflection pin to deflection pin.

5. The adjustment interface as recited in claim 4, wherein the projections are a series of directional serrations whose points directionally project to provide greater resistance to rotation of the dial in a first direction of rotation and lesser resistance to rotation of the dial in an opposing direction of rotation.

6. The adjustment interface as recited in claim 1, wherein the rotatable controller adjustment member is operatively connected to a gas valve controller for controlling gas valve operation for a gas fired heating device.

7. The adjustment interface as recited in claim 1, wherein the rotatable controller adjustment member is operatively connected to an electrical heating element controller for controlling electrical heating element operation for an electrically fired heating device.

8. A method for adjusting a controller that controls the temperature of a heating device comprising:

providing a controller cover panel having a rotatable controller adjustment member having an end portion extending through an opening of the controller cover panel beyond an exterior surface of said controller cover panel, wherein said rotatable controller adjustment member is operable to adjust a controller when said rotatable controller adjustment member is rotated;

providing a ring member mounted to axially extend beyond and away from the exterior surface of said controller cover panel in substantially the same direction as the extension of the rotatable controller adjustment member, wherein the ring member has projections radially extending from an exterior perimeter of the ring member;

providing a control member operatively connected to said rotatable controller adjustment member beyond the axial extension of the ring member and said control member operable to effect rotation of the rotatable controller adjustment member when said control member is grasped and turned and said control member having a deflection pin extending therefrom having sufficient length and orientation to crossingly engage the projections extending from the exterior perimeter of the ring member such that the deflection pin resistively engages the projections and flexes to travel radially over and disengaging the projections when the control member is turned with sufficient torque; and rotating the control member with sufficient torque to effect rotation.

9. The adjustment interface as recited in claim 8, wherein the rotatable controller adjustment member is a rotatable shaft and the control member is a dial attached to the end of the rotatable shaft.

10. The adjustment interface as recited in claim 9, wherein the ring member is mounted to the exterior surface of the controller cover panel and wherein the dial has a plurality of deflection pins having sufficient length and orientation to crossingly engage the projections extending from the exterior perimeter of the ring member such that the plurality of deflection pins resistively engage the projections and flex to travel radially over and disengaging the projections when the control member is turned with sufficient torque.

11. The adjustment interface as recited in claim 10, wherein the dial is circular in shape and having an inner dial surface and wherein the plurality of deflection pins extend from the inner dial surface to engage the projections and where the plurality of pins comprise three deflection pins angularly spaced about a perimeter of the dial about approximately 120 degrees apart deflection pin to deflection pin.

12. The adjustment interface as recited in claim 11, wherein the projections are a series of directional serrations whose points directionally project to provide greater resistance to rotation of the dial in a first direction of rotation and lesser resistance to rotation of the dial in an opposing direction of rotation.

13. The adjustment interface as recited in claim 8, wherein the rotatable controller adjustment member is operatively connected to a gas valve controller for controlling gas valve operation for a gas fired heating device.

14. The adjustment interface as recited in claim 8, wherein the rotatable controller adjustment member is operatively connected to an electrical heating element controller for controlling electrical heating element operation for an electrically fired heating device.

* * * * *